US006766850B2

(12) United States Patent
Gegel et al.

(10) Patent No.: US 6,766,850 B2
(45) Date of Patent: Jul. 27, 2004

(54) PRESSURE CASTING USING A SUPPORTED SHELL MOLD

(75) Inventors: Gerald A. Gegel, Morton, IL (US); David Weiss, Manitowoc, WI (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/026,730

(22) Filed: Dec. 27, 2001

(65) Prior Publication Data

US 2003/0121636 A1 Jul. 3, 2003

(51) Int. Cl.[7] ..... B22D 27/09
(52) U.S. Cl. ..... 164/113; 164/35; 164/361
(58) Field of Search ..... 164/35, 113, 361

(56) References Cited

U.S. PATENT DOCUMENTS

| | | | | | |
|---|---|---|---|---|---|
| 2,851,752 | A | | 9/1958 | Benham | 22/193 |
| 2,875,485 | A | * | 3/1959 | Schneider | 164/24 |
| 2,880,486 | A | * | 4/1959 | Wallace | 164/24 |
| 3,010,852 | A | | 11/1961 | Prange et al. | 134/5 |
| 3,204,303 | A | * | 9/1965 | Chandley | 164/23 |
| 3,239,897 | A | | 3/1966 | Lirones | 22/196 |
| 3,743,003 | A | | 7/1973 | Brown | 164/16 |
| 4,204,872 | A | | 5/1980 | Hayati et al. | 106/38.35 |
| 4,298,051 | A | * | 11/1981 | Page | 164/72 |
| 4,616,630 | A | * | 10/1986 | Arakawa | 600/131 |
| 4,700,768 | A | * | 10/1987 | Broihanne et al. | 164/361 |
| 4,995,443 | A | | 2/1991 | Easwaran | 164/34 |
| 5,069,271 | A | | 12/1991 | Chandley et al. | 164/516 |
| 5,072,770 | A | | 12/1991 | Yodice | 164/34 |
| 5,296,308 | A | | 3/1994 | Caccavale et al. | 428/586 |
| 5,339,888 | A | | 8/1994 | Tanner, Jr. | 164/516 |
| 5,368,086 | A | | 11/1994 | Kloskowski | 164/33 |
| 5,607,007 | A | * | 3/1997 | Chandley | 164/122.2 |
| 5,735,335 | A | | 4/1998 | Gilmore et al. | 164/516 |
| 6,189,598 | B1 | | 2/2001 | Chandley et al. | 164/34 |
| 6,422,293 | B1 | * | 7/2002 | Comarteau et al. | 164/63 |

* cited by examiner

*Primary Examiner*—M. Alexandra Elve
*Assistant Examiner*—Len Tran
(74) *Attorney, Agent, or Firm*—Finnegan, Henderson, Farabow, Garrett & Dunner

(57) ABSTRACT

A method of casting including forming a shell mold around a pattern fabricated from an expendable material and then removing the expendable material from the shell mold. The shell mold is located within a housing such that an inlet port of the shell mold communicates with an opening in the housing. A supporting material is provided and substantially fills an open volume between an external surface of the shell mold and an interior surface of the housing. A molten material is then pressure cast through the inlet port and into the shell mold. The invention includes a mold assembly and a casting system useful in practicing the disclosed method.

31 Claims, 6 Drawing Sheets

PRESSURE CASTING USING A SUPPORTED SHELL MOLD

TECHNICAL FIELD

This invention relates generally to casting and, more particularly, to systems and methods for pressure casting parts using a supported shell mold.

BACKGROUND

Pressure casting is a known technique that when used with certain alloys can produce desirable properties. However, a part having re-entrant features, which are undercut features positioned perpendicular to the molding pressure axis, could not be pressure cast in the ordinary way because the presence of re-entrant features would prevent the removal of the cast part from the permanent die molds. Instead, parts including re-entrant features were typically cast by gravity pouring or vacuum flowing liquid metal into a plaster or ceramic mold. Parts formed in this manner may lack the mechanical properties of high-pressure, permanent mold casting.

Chandley et al., in U.S. Pat. No. 5,069,271, describe an example of one such process. The Chandley et al. process involves applying a vacuum to an investment-type mold to draw molten metal into the mold in a counter-gravity casting process. As with all casting processes of this type, however, this process is conducted at fairly low pressures, which leads to porosity and shrinkage as the molten metal solidifies. As a result, this type of process lacks the mechanical property capabilities of high-pressure, permanent mold casting.

Furthermore, known pressure casting processes utilize turbulent filling of the mold cavity, which leads to formation of oxide-type defects and gas porosity in the cast parts. Ultimately, these defects negatively impact the fatigue properties of the resulting parts. Moreover, known pressure casting processes are useful with only a limited selection of alloys due to the tendency of certain alloys to solder to permanent molds.

The present invention solves one or more of the problems associated with the methods of the prior art and combines the benefits of high-pressure, permanent mold casting with the flexibility of being able to create a wide array of parts, including those with re-entrant features.

SUMMARY OF THE INVENTION

One aspect of the present invention includes a method of casting. This method includes investing a shell mold around a pattern fabricated from an expendable material and then removing the expendable material from the shell mold. The shell mold is located within a housing such that an inlet port of the shell mold communicates with an opening in the housing. A supporting material is provided and substantially fills an open volume between an external surface of the shell mold and an interior surface of the housing. A molten material is then pressure cast through the inlet port and into the shell mold.

A second aspect of the present invention includes a casting system. This system includes a pressure casting apparatus having an inlet sprue and a die cavity. A mold assembly is configured to fit within the die cavity. The mold assembly includes a housing including an interior volume and an opening through a wall of the housing. A refractory shell mold is disposed within the interior volume of the housing. The refractory shell mold includes an internal mold cavity and has an inlet port that communicates with the opening in the housing and mates with the inlet sprue. A supporting material substantially fills a volume between an external surface of the refractory shell mold and an interior surface of the housing.

BRIEF DESCRIPTION OF THE DRAWINGS

The accompanying drawings, which are incorporated in and constitute a part of this specification, illustrate exemplary embodiments of the invention and, together with the written description, serve to explain the principles of the invention. In the drawings.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the present invention. The following description is, therefore, not to be taken in a limited sense. Wherever possible, the same reference numbers are used throughout the drawings to refer to the same or like parts.

Figure 1A:
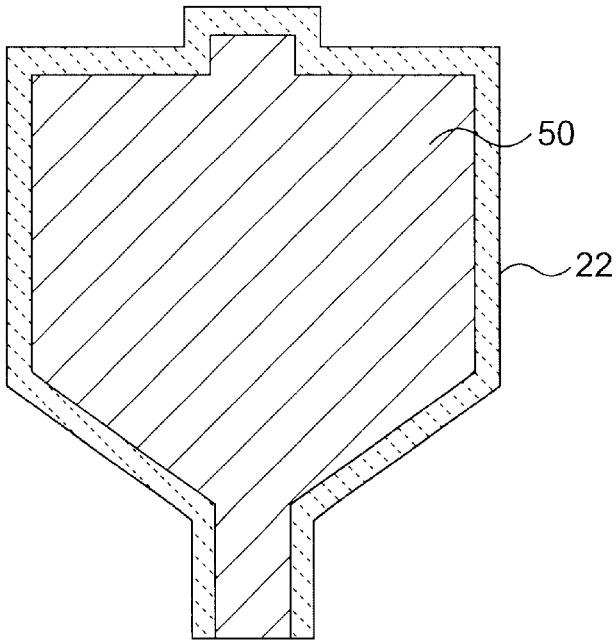
FIGS. 1A and 1B are diagrammatic representations of a shell mold formed on an expendable pattern in accordance with an exemplary embodiment of the invention.

As a first step in the method for casting a part, according to the present invention, a pattern of the part is formed from an expendable material. FIG. 1A depicts a cross-sectional view of pattern 50, which serves as a replica of the desired part. While pattern 50 includes every surface feature of the part to be cast, the dimensions of the pattern 50 may be chosen to account for any known behavior of the casting materials or the mold materials during the casting process. For example, pattern 50 may be dimensioned slightly larger than the desired part in anticipation of a certain degree of shrinkage in the casting material as it solidifies. Pattern 50 can be formed from a wide range of expendable materials. Suitable expendable materials include, for example, wax, wax blends, polystyrene, plastics, and evaporative foam.

Once pattern 50 has been formed, a shell mold 22 is formed around pattern 50. This process involves preparing a small-particle slurry (not shown) and repeatedly dipping pattern 50 into the slurry to form a multi-layered thin shell.

Figure 1B:
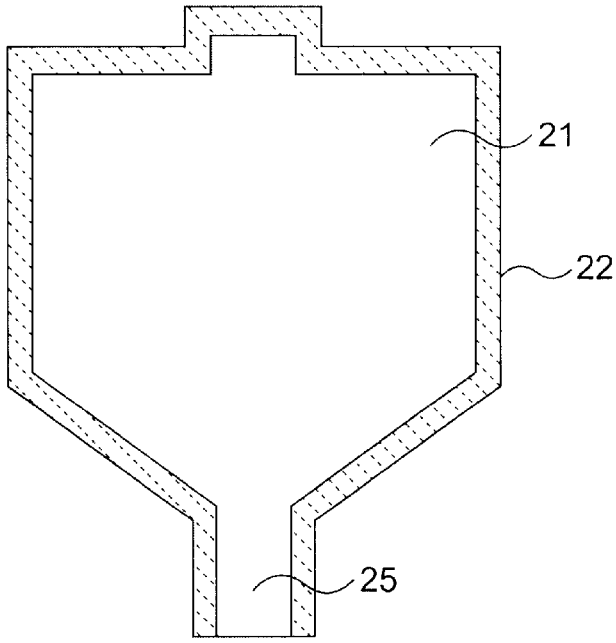

In forming the shell mold 22, a portion of the pattern 50 is left uncoated to preserve an entryway into the shell mold. This uncoated portion coincides with the inlet port 25 (FIG. 1B). In general, the slurry may include a ceramic-based, refractory powder of, for example, alumina or zirconia along with additives such as fillers and binders for adjusting the properties of the slurry. After each successive dip of pattern 50 into the slurry, pattern 50 is stuccoed with dry refractory particles. Because shell mold 22 is a supported shell mold, there is a reduced need for the structural strength that the dry refractory particles provide. Therefore, only a thin layer of small particles is required. Use of only a minimal amount of small stuccoing particles also serves to avoid degradation of surface properties of the cast part.

This process of dipping and stuccoing is repeated until shell mold 22 has a desired wall thickness. To maximize heat transfer, the wall thickness of shell mold 22 should be as thin as possible. On the other hand, the wall thickness of shell mold 22 must be thick enough to withstand pressures imparted upon the shell mold 22 during removal of pattern 50 and during casting. While the present invention may be practiced with a wide range of wall thicknesses of shell mold 22, a suitable balance between structural properties and heat transfer is achieved in the exemplary embodiments with a wall thickness of from about 4 mm to about 8 mm.

Once the desired wall thickness has been obtained, the shell mold 22 is allowed to dry. Pattern 50 is then removed from the shell mold 22 by applying heat. This applied heat serves two functions. First, it melts and/or evaporates the expendable material of pattern 50, which allows the pattern material to drain away through, for example, inlet port 25. Removal of pattern 50 leaves an open mold cavity 21, as shown in FIG. 1B. Second, the applied heat also sinters the refractory, ceramic-based material of the shell mold 22.

Figure 2:
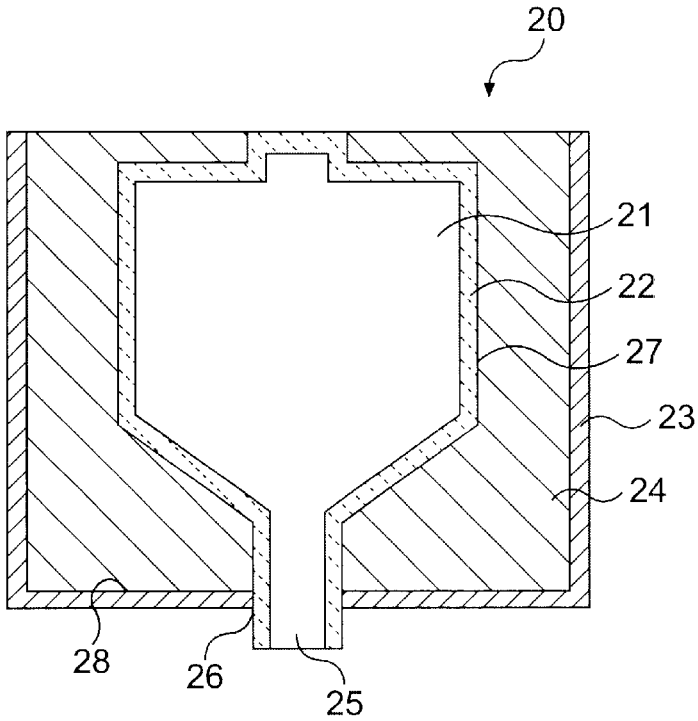
FIG. 2 is a diagrammatic representation of a mold assembly including a metallic alloy supporting material in accordance with an exemplary embodiment of the invention.

With reference to FIG. 2, an example of a mold assembly 20, according to an exemplary embodiment of the present invention, is shown in cross-section. The shell mold 22 is centrally located in a housing 23 such that the inlet port 25 of the shell mold 22 communicates with an opening 26 in the housing. As shown in FIG. 2, for example, the inlet port 25 may extend through the opening 26 in housing 23. The housing 23 may be fabricated from a variety of high-strength materials, including steel.

Once the shell mold 22 is positioned within housing 23, an open volume exists between the exterior surface 27 of the shell mold 22 and the interior surface 28 of the housing 23. This open volume is filled by disposing a supporting material 24 within the housing 23. Supporting material 24 substantially fills the open volume such that all surfaces of the shell mold 22 are covered and supported by the supporting material 24.

Supporting material 24 may provide structural support to the shell mold 22 and facilitate heat transfer away from the shell mold 22. In the exemplary embodiment of the present invention illustrated in FIG. 2, the supporting material 24 includes a low melting point metallic alloy, which is poured into the mold assembly 20 in molten form and allowed to solidify around shell mold 22. In addition to low melting point metallic alloys, other suitable materials may be used for supporting material 24 depending upon a given application. In the exemplary embodiment, the low melting point metallic alloy has a melting temperature of no greater than about 300° C. and achieves volume expansion upon solidification to ensure intimate contact with all surfaces of both the shell mold 22 and the housing 23. Such an arrangement provides maximum thermal transfer between the components of the mold assembly 20. Suitable materials for the metallic alloy supporting material 24 include alloys of lead bismuth, and antimony.

Figure 3:
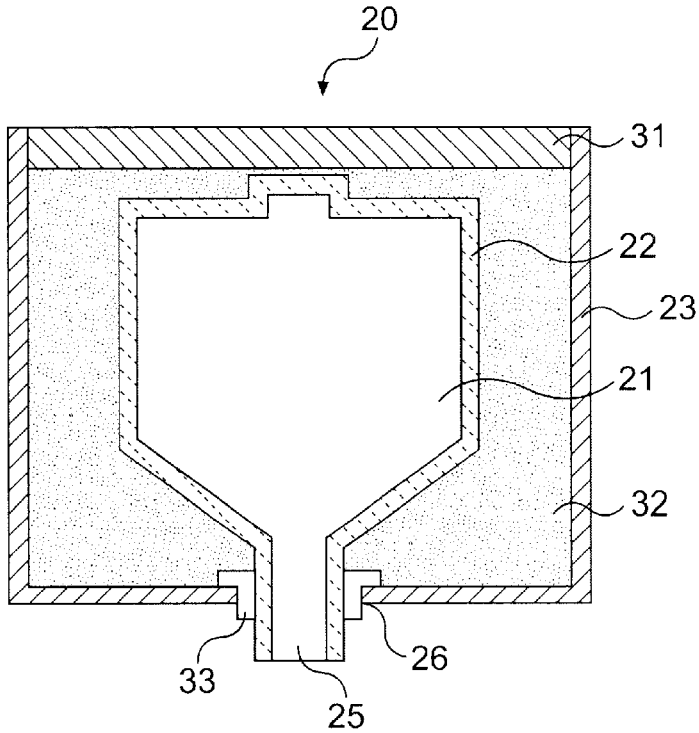
FIG. 3 is a diagrammatic representation of a mold assembly including a granular supporting material in accordance with an exemplary embodiment of the invention.

In yet another example of the present invention, as illustrated in FIG. 3, the supporting material 32 includes a granular material. In this embodiment, the granular supporting material 32 is poured into the mold assembly 20 until the supporting material 32 substantially fills the open volume between the housing 23 and the shell mold 22, i.e., all surfaces of the shell mold 22 are covered and supported by the supporting material 32. The granular supporting material 32 may include at least one of carbon particles, natural or synthetic alumina-based sand, zirconia-based sand, and metal particles. Ultimately, the choice of materials included in the granular supporting material 32 is dependent upon the desired thermal conductivity capability of those materials in relation to a particular application. The particular particle size distribution of the granular supporting material 32 may be selected to maximize the packing density within the mold assembly 20.

Once the granular supporting material 32 has been disposed within the housing 23, the mold assembly 20 may be subjected to low frequency vibration to ensure maximized packing density of the granular supporting material 32. Additionally, a compaction plate 31 may be provided to aid in compaction of the granular supporting material 32. Maintaining the granular supporting material 32 at a maximum packing density offers the highest degree of thermal conductivity possible with the selected granular supporting material 32. As an optional element, a seal 33 may be provided between the housing 23 and the inlet port 25. If the dimensions between the inlet port 25 and the opening 26 in the housing 23 are sufficiently close, however, no seal is necessary.

It should be noted that housing 23 may optionally be omitted from an exemplary embodiment of the present invention. For example, instead of placing the shell mold 22 within housing 23 and subsequently filling the volume between the shell mold 22 and the housing 23 with a supporting material 24 or 32, the supporting material 24 or 32 may be applied directly to the shell mold in the absence of housing 23. In the case of supporting material 24, which may include a low melting point metallic alloy, the shell mold 22 may be introduced into an intermediate mold (not shown), and the low melting point metallic alloy may be poured around the shell mold 22 and allowed to solidify. The use of an intermediate mold would allow for application of supporting material 24 in any desired shape without the use of housing 23.

Additionally, the housing 23 may be omitted in certain embodiments that include granular supporting material 32. For example, in addition to the granular media, which may include at least one of carbon particles, natural or synthetic alumina-based sand, zirconia-based sand, and metal particles, granular supporting material 32 may also include a binder material. Such a binder material may hold the particles of the granular supporting material 32 together such that the granular supporting material 32 becomes a self-supporting granular material. Examples of binder materials may be selected from among known binder materials used in the foundry industry. The self-supporting granular material may be applied to the shell mold 22 in the absence of a housing 23, and it may be formed into any desired shape or configuration.

Figure 4:
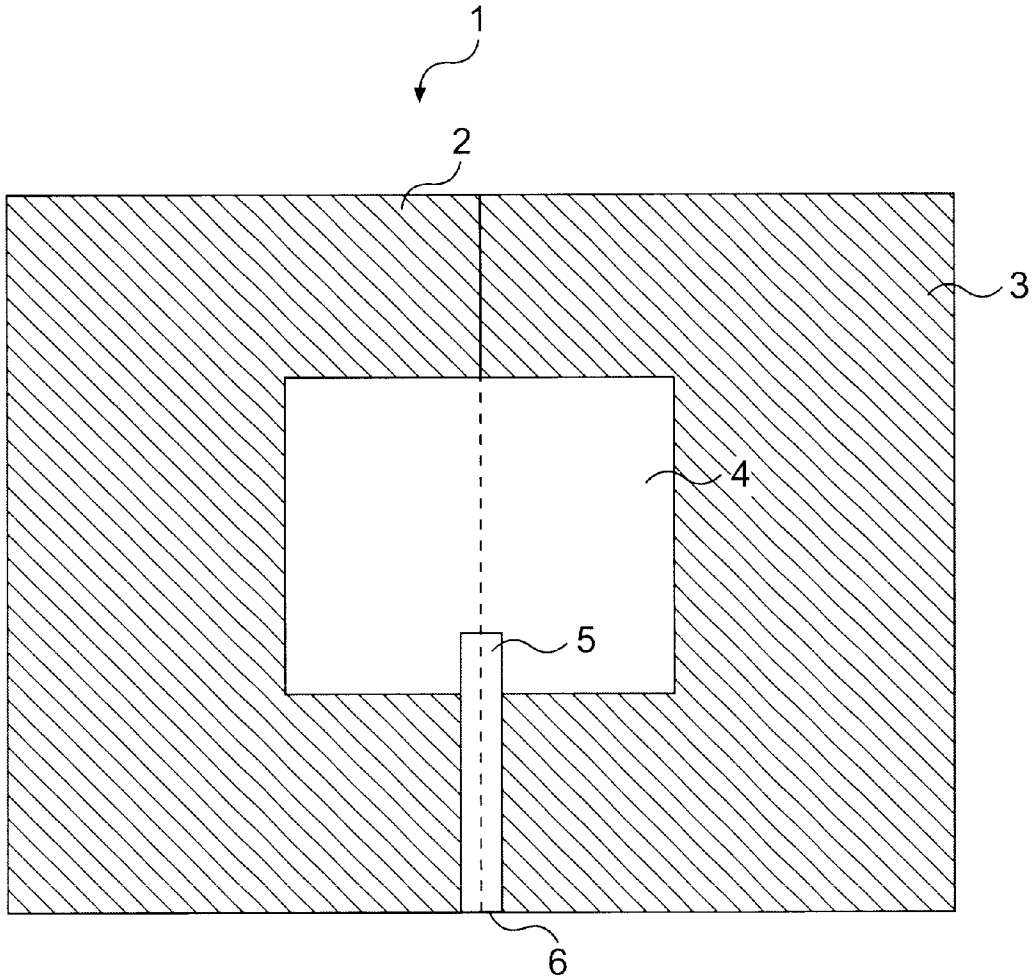
FIG. 4 is a diagrammatic representation of a pressure casting apparatus in accordance with an exemplary embodiment of the invention.
Figure 5:
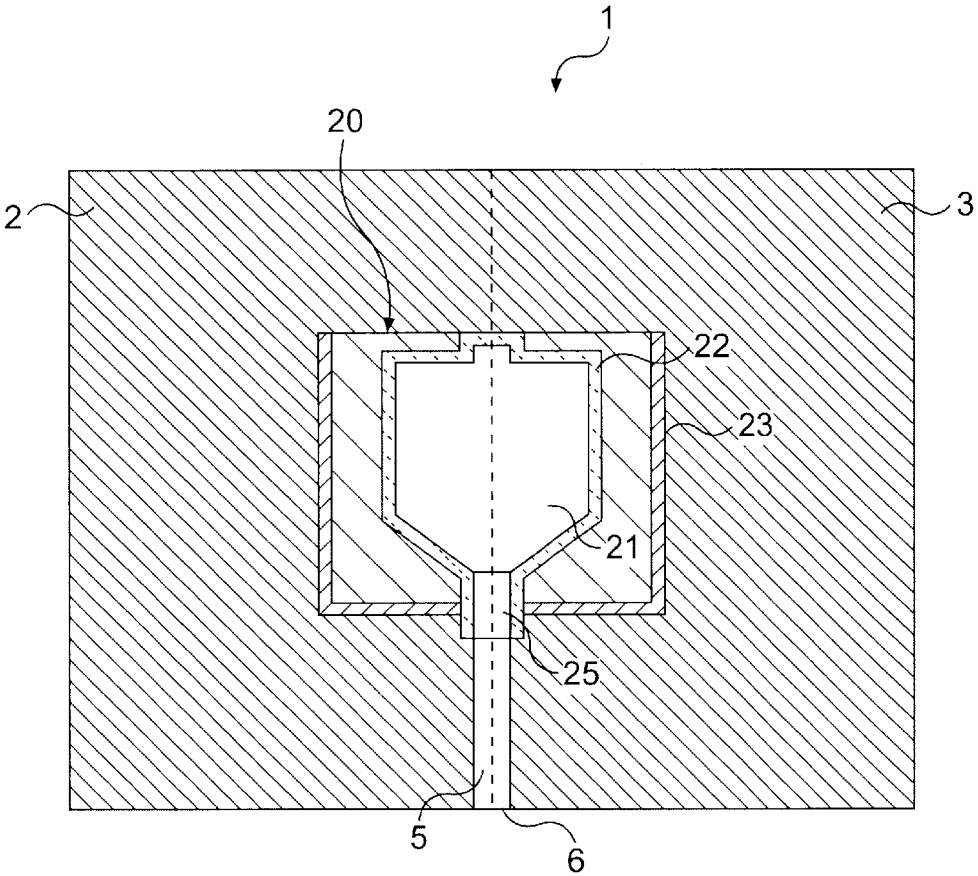
FIG. 5 is a diagrammatic representation of a pressure casting apparatus including the mold assembly in accordance with an exemplary embodiment of the invention.

Referring to FIGS. 4 and 5, a pressure casting apparatus 1 is shown that includes die blocks 2 and 3, die cavity 4, inlet sprue 5, and in-gate 6. Mold assembly 20 is configured such that the dimensions of the die cavity 4 in the pressure casting apparatus 1 are only marginally larger than the dimensions of the housing 23. In the exemplary embodiment, the housing 23 is dimensioned such that a gap of no more than about 0.3 mm per surface exists between the housing 23 and the die cavity 4. In other words, each surface of the housing 23 is spaced apart from the corresponding and opposing surface of the die cavity 4 by no more than 0.3 mm. Some examples of configurations for the die cavity 4 include a sphere, a cube, a rectangle, and a cylinder. Any of these die cavity configurations may include rounded edges. Through this arrangement, die blocks 2 and 3 provide structural support to the housing 23, and ultimately, to the shell mold 22. Further, this arrangement establishes a pathway for efficient transfer of heat from the mold assembly 20 to the die blocks 2 and 3.

Referring to FIG. 5, there is illustrated a pressure casting apparatus 1, including die blocks 2 and 3. Once mold assembly 20 has been fully assembled, the room temperature mold assembly 20 is disposed within the die cavity 4 (FIG. 4) of the pressure casting apparatus 1 formed between die blocks 2 and 3. If a compaction plate 31 (FIG. 3) is included in the mold assembly 20, then a load is applied to the compaction plate 31, which may be clamped into place to maintain the granular supporting material 32 (FIG. 3) at the maximum packing density. The inlet sprue 5 of the pressure casting apparatus 1 mates with the inlet port 25 of the shell mold 22 and extends into the mold cavity 21. At this stage, pressure casting of a molten material through the inlet sprue 5 and into the mold cavity 21 may commence.

Again, it should be noted that housing 23 may be omitted from mold assembly 20. Instead of using a housing 23 to encapsulate the shell mold 22 and the supporting material 24 or 32 (FIGS. 2 and 3), the shell mold 22 may be located directly within die cavity 4 (FIG. 4). In this exemplary embodiment, supporting material 24, which may include a low melting point metallic alloy, or supporting material 32, which may include a granular material, would be introduced directly into the die cavity 4 to substantially fill the volume within the die cavity 4 that is external to the exterior surface of the shell mold 22.

The pressure casting process of the present invention begins by hydraulically pressurizing a molten casting material and flowing this material into the in-gate 6, through the inlet sprue 5, and into the mold cavity 21. Suitable casting materials include, for example, aluminum, magnesium, zinc, copper, and alloys of these materials. Other materials having a suitable melting temperature of, for example, up to about 1600° F. (871° C.) may be utilized. Depending on the application, the process may be adapted for use with materials having a higher melting temperature. The molten casting material may be introduced into the mold cavity 21 of the shell mold 22 at a non-turbulent flow velocity. Such a controlled, slow fill of the molding cavity 21 eliminates turbulence, which reduces the formation of oxide-type defects. The non-turbulent flow velocity also decreases the amount of entrapped gases with the molten material, which leads to fewer and smaller pores once the molten material is solidified.

The controlled filling of the mold cavity 21 continues until the mold cavity is completely full of molten material and a predetermined solidification pressure has been achieved. During the disclosed process, the shell mold 22 is supported by at least the supporting material 24 or 32, the die blocks 2 and 3 of the pressure casting apparatus 1, and optionally the housing 23. By supporting the shell mold 22 in this manner, solidification pressures higher than in other types of casting processes, such as investment casting, for example, are possible. Specifically, once the molten material has been introduced into and has filled the shell mold 22 of the exemplary embodiment, a pressure of from about 100 psi (0.689 MPa) to about 10,000 psi (68.9 MPa) may be applied to the molten material. Other pressures may be used dependent upon a given application. Solidification of the molten material under such an applied pressure facilitates a reduction in the size and quantity of gas pores and promotes the feeding of molten material into pores generated by solidification shrinkage.

After solidification of the molten material, the mold assembly 20 is removed from the die cavity of the pressure casting machine 1 and transferred to a part removal station (not shown). Here, any remaining support material 24 or 32 is removed from the shell mold 22. To remove the metallic alloy supporting material 24, heat is applied to the metallic alloy supporting material 24 at a temperature of from about 10° C. to about 38° C. above the melting temperature of the metallic alloy. As the metallic alloy supporting material 24 melts, it is drained away and recycled. In the case of the granular supporting material 32, the compaction plate 31 is removed from the mold assembly 20, and a vacuum is applied to remove the granular supporting material 32. Once removed from the mold assembly 20, the granular supporting material 32 is recycled. Next, the shell mold 22, which contains the cast part, is removed from the housing 23, and the shell mold 22 is removed from the cast part.

Industrial Applicability

Figure 6A:
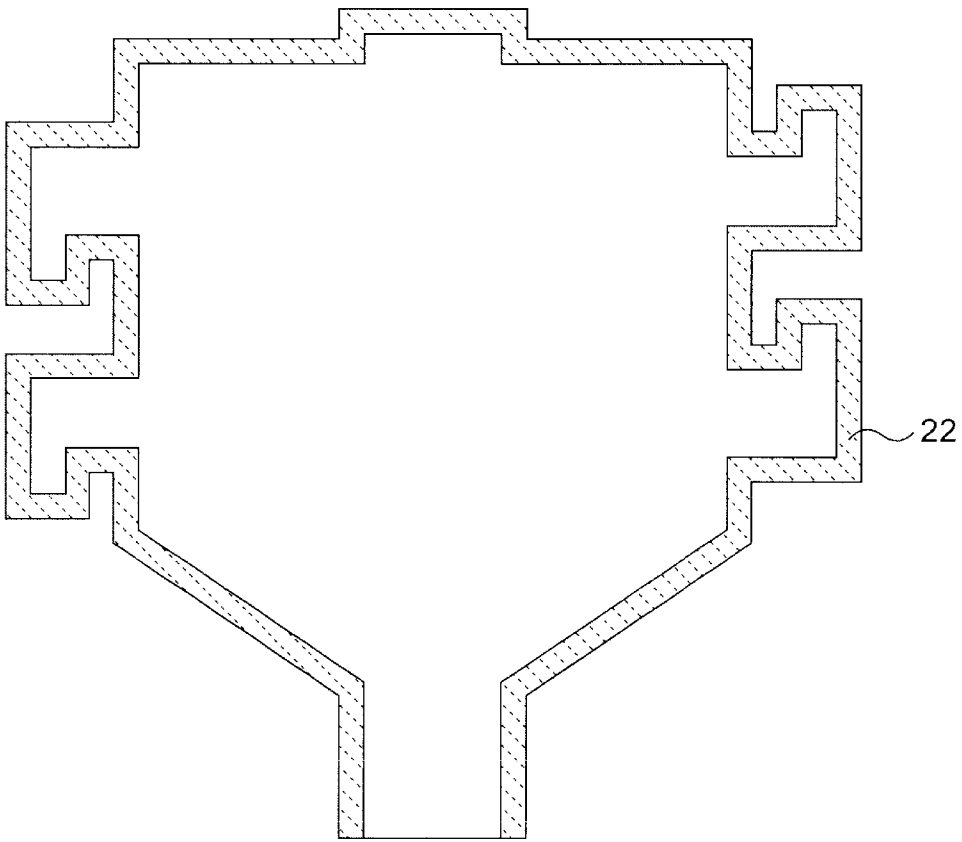
FIG. 6A is a diagrammatic representation of a shell mold formed with re-entrant features in accordance with an exemplary embodiment of the invention.
Figure 6B:
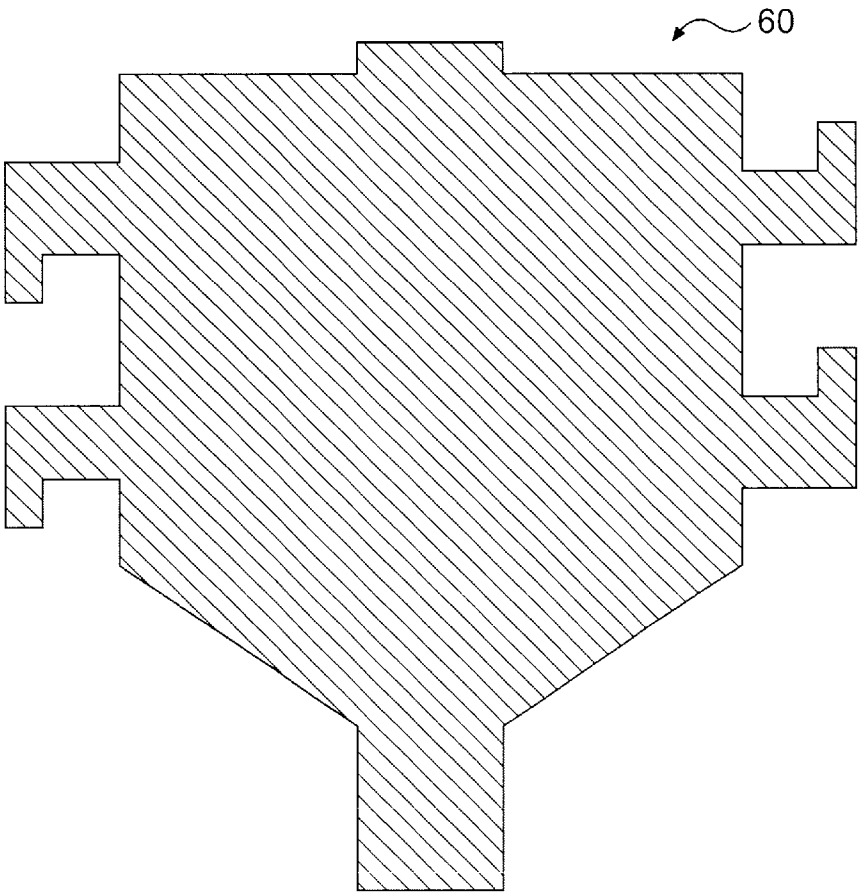
FIG. 6B is a diagrammatic representation of a part formed with re-entrant features in accordance with an exemplary embodiment of the invention.

The present invention, by providing a removable, refractory shell-type mold adapted for use in a pressure casting apparatus, takes advantage of the near-net-shape and dimensional tolerance capabilities provided by pressure casting, yet it offers the flexibility of casting many types of parts, including those with re-entrant features. FIG. 6A illustrates, in cross-section, a shell mold 22 formed according to an exemplary embodiment of the present invention. As shown, shell mold 22 includes several re-entrant features, which could not be created using permanent molds in a high-temperature, pressure casting process. FIG. 6B illustrates, in cross-section, a part 60 having re-entrant features. Part 60 may be formed, for example using shell mold 22 as shown in FIG. 6A.

The present invention may also permit pressure casting of alloys that are not normally pressure cast due to their tendency to solder to permanent molds. Further, the present invention may permit non-turbulent filling of the mold cavity and solidification under pressure, which ultimately enhance the fatigue properties of cast parts.

The described pressure casting process is intended to create a near-net-shape part, which means that the finished part has dimensions as close to the targeted dimensions as possible. In certain embodiments, the near-net-shape part will meet many of the targeted dimensions. In still other embodiments the cast part may even be net-shape and meet all targeted dimensions.

Other aspects and features of the present invention can be obtained from a study of the disclosure and the appended claims.

What is claimed is:

1. A method of casting a part, comprising:

forming a shell mold around a pattern fabricated from an expendable material;

removing the pattern from the shell mold;

locating the shell mold within a housing such that an inlet port of the shell mold communicates with an opening in the housing;

providing a supporting material that substantially fills an open volume between an external surface of the shell mold and an interior surface of the housing; and pressure die casting a molten material through the inlet port and into the shell mold.

2. The method of claim 1, wherein the pressure casting step further includes introducing the molten material into the shell mold at a non-turbulent flow velocity.

3. The method of claim 1, wherein the molten material is introduced into the shell under a pressure of from about 100 psi to about 10,000 psi.

4. The method of claim 1, further including removing and recycling the supporting material.

5. The method of claim 4, further including removing the shell mold from the part.

6. The method of claim 1, wherein the expendable material includes wax.

7. The method of claim 1, wherein the expendable material includes evaporative foam.

8. The method of claim 1, wherein the shell mold includes a refractory material.

9. The method of claim 1, wherein the supporting material is a granular material.

10. The method of claim 1, wherein the supporting material is a low melting point metallic alloy.

11. The method of claim 10, wherein the low melting point metallic alloy achieves volume expansion upon solidification.

12. The method of claim 1, wherein the shell mold includes re-entrant features.

13. A method of casting a part, comprising:

providing a shell mold having an inlet port;

locating the shell mold within a housing such that the inlet port of the shell mold communicates with an opening in the housing;

providing a supporting material that substantially fills an open volume between an external surface of the shell mold and an interior surface of the housing;

pressure die casting a molten material through the inlet port and into the shell mold;

removing the supporting material from the housing; and removing the shell mold containing the part from the housing and removing the part from the shell old.

14. The method of claim 13, wherein the shell mold has a wall thickness of between about 4 mm to about 8 mm.

15. The method of claim 13, wherein the supporting material is a granular material.

16. The method of claim 13, wherein the supporting material is a metallic alloy and is removed by melting and draining the metallic alloy from the housing.

17. A method of casting a part, comprising:

forming a refractory shell mold around a pattern fabricated from an expendable material;

locating the refractory shell mold within a housing such that an inlet port of the refractory shell mold extends through an opening in the housing;

providing a supporting material that substantially fills an open volume between an external surface of the shell mold and an interior surface of the housing;

placing the housing into a die cavity of a pressure casting apparatus such that an inlet sprue of the pressure casting apparatus mates with the inlet port of the refractory shell mold;

introducing a molten material into the refractory shell mold at a non-turbulent flow velocity and under a pressure of from about 100 psi to about 10,000 psi;

removing the housing from the die cavity;

removing the supporting material; and removing the refractory shell mold from the part.

18. The method of claim 17, wherein the step of forming the refractory shell mold further includes heating the refractory shell mold to remove the pattern and sintering the refractory shell mold.

19. The method of claim 17, wherein the refractory shell mold includes re-entrant features.

20. A method of casting a part, comprising:

forming a shell mold around a pattern fabricated from an expendable material;

removing the pattern from the shell mold;

locating the shell mold within a housing such that an inlet port of the shell mold communicates with an opening in the housing;

providing a supporting material that substantially fills an open volume between an external surface of the shell mold and an interior surface of the housing; and pressure casting a molten material through the inlet port and into the shell mold;

wherein the molten material is introduced into the shell mold under a pressure of from about 100 psi to about 10,000 psi.

21. A method of casting a part, comprising:

forming a shell mold around a pattern fabricated from an expendable material;

removing the pattern from the shell mold;

locating the shell mold within a die cavity of a pressure casting apparatus such that an inlet port of the shell mold communicates with an inlet sprue of the pressure casting apparatus;

providing a supporting material that substantially fills an open volume between an external surface of the shell mold and an interior surface of the die cavity; and pressure die casting a molten material through the inlet port and into the shell mold.

22. The method of claim 21, wherein the pressure casting step further includes introducing the molten material into the shell mold at a non-turbulent flow velocity.

23. The method of claim 21, wherein the molten material is introduced into the shell under a pressure of from about 100 psi to about 10,000 psi.

24. The method of claim 21, wherein the shell mold includes a refractory material.

25. The method of claim 21, wherein the supporting material is a granular material.

26. The method of claim 21, wherein the supporting material is a low melting point metallic alloy.

27. The method of claim 26, wherein the low melting point metallic alloy achieves volume expansion upon solidification.

28. A method of casting a part, comprising:

providing a shell mold having an inlet port;

covering the shell mold with a supporting material;

locating the shell mold and the supporting material within a die cavity of a pressure casting apparatus such that the inlet port of the shell mold communicates with an inlet sprue of the pressure casting apparatus; and pressure die casting a molten material through the inlet port and into the shell mold.

29. The method of claim 28, wherein the supporting material is a self-supporting granular material that is shaped to substantially fill a volume within the die cavity external to the shell mold.

30. The method of claim 29, wherein the self-supporting granular material includes a granular media and a binder material.

31. The method of claim 28, wherein the supporting material is a low melting point metallic alloy shaped to substantially fill a volume within the die cavity external to the shell mold.

* * * * *